United States Patent [19]

Gill et al.

[11] Patent Number: 4,668,474

[45] Date of Patent: May 26, 1987

[54] MERCAPTOBENZOTHIAZOLE AND FERROUS ION CORROSION INHIBITING COMPOSITIONS

[75] Inventors: Jasbir S. Gill; Richard G. Varsanik, both of Coraopolis, Pa.

[73] Assignee: Calgon Corporation, Pittsburgh, Pa.

[21] Appl. No.: 757,231

[22] Filed: Jul. 22, 1985

[51] Int. Cl.[4] ..... C23F 11/14; C23F 11/16

[52] U.S. Cl. ..... 422/14; 422/14; 422/19; 252/389.53; 252/391; 252/394; 252/395

[58] Field of Search ..... 422/12, 73, 14, 16, 422/19; 252/75, 146, 388, 389.1, 391, 394, 395; 210/698, 700

[56] References Cited

U.S. PATENT DOCUMENTS

| | | | |
|---|---|---|---|
| 2,194,491 | 3/1940 | Bird et al. | 210/698 X |
| 3,959,166 | 5/1976 | Oberhofer et al. | 252/75 X |
| 4,219,433 | 8/1980 | Manabe et al. | 422/16 X |

FOREIGN PATENT DOCUMENTS

| | | | |
|---|---|---|---|
| 0192269 | 11/1982 | Japan | 422/14 |
| 0145019 | 8/1984 | Japan | 422/13 |

OTHER PUBLICATIONS

*Chemical Engineering,* edited M. M. Hoover, Dec., 1954, pp. 230, 232, 234.

*Primary Examiner*—Barry S. Richman
*Assistant Examiner*—William R. Johnson
*Attorney, Agent, or Firm*—W. C. Mitchell; R. B. Olson; M. C. Sudol, Jr.

[57] ABSTRACT

The present invention is directed to a composition and method for inhibiting the corrosion of copper and copper alloy metals in aqueous systems. The composition comprises mercaptobenzothiazole and added ferrous ions in a ratio of 1:1 to 1:10, by weight. The method comprises adding this composition to the aqueous system being treated.

3 Claims, No Drawings

MERCAPTOBENZOTHIAZOLE AND FERROUS ION CORROSION INHIBITING COMPOSITIONS

BACKGROUND OF THE INVENTION

Mercaptobenzothiazole is a well-known copper inhibitor. It was surprisingly discovered however that the presence of ferrous ion provides significantly better corrosion inhibition of copper and copper alloys than either of the components alone.

DESCRIPTION OF THE INVENTION

The present invention is directed to a composition useful for inhibiting the corrosion of copper and copper alloy metals in an aqueous system comprising mercaptobenzothiazole and ferrous ions.

The present invention is also directed to a method of inhibiting the corrosion of copper and copper alloy metals in an aqueous system comprising maintaining in the aqueous system at least about 1 ppm (parts per million) of a composition comprising mercaptobenzothiazole and ferrous ions.

Any source of ferrous ions may be used. Examples include $K_4Fe(CN)_6 \cdot 3H_2O$.

The compositions of the present invention are effective in inhibiting corrosion of copper and copper alloy metals when maintained in an aqueous system at a concentration of at least about 1 ppm, preferably about 5 to 100 ppm. Maximum concentrations are determined by the economic considerations of the particular application.

Although any combination of mercaptobenzothiazole and ferrous ions may be used, it has been found especially synergistic in a ratio of 1:1 to 1:10. The preferred concentration of mercaptobenzothiazole is 2.5 ppm.

The preferred concentration of ferrous ion is 2.5 to 10 ppm.

EXAMPLES

The tests were conducted in water containing 3 percent sodium chloride at 50° C. The corrosion rates shown in the table are four linear polymerization runs using 443 admiralty brass coupons expressed in mils per year (mpy). The coupons were prepared, cleaned and evaluated according to the ASTM method G1. The results of this test are reported in the following table:

TABLE

| Additive | Corrosion Rate (mpy) |
|---|---|
| 0 ppm MBT + 5.0 ppm $Fe^{2+}$ | 1.79 |
| 2.5 ppm MBT + 0.0 ppm $Fe^{2+}$ | 3.77 |
| 2.5 ppm MBT + 1.0 ppm $Fe^{2+}$ | 2.80 |
| 2.5 ppm MBT + 2.5 ppm $Fe^{2+}$ | 1.58 |
| 2.5 ppm MBT + 5.0 ppm $Fe^{2+}$ | 1.02 |
| 2.5 ppm MBT + 10.0 ppm $Fe^{2+}$ | 0.41 |

MBT = mercaptobenzothiazole
$Fe^{2+}$ = $K_4Fe(CN)_6 \cdot 3H_2O$

What we claim is:

1. A method of inhibiting the corrosion of copper and copper alloys in an aqueous system comprising maintaining in said aqueous system at least about 1 ppm of a composition comprising mercaptobenzothiazole and added ferrous ion, wherein the ratio of mercaptobenzothiazole to added ferrous ion is 1:1 to 1:10 by weight.

2. The method of claim 1, wherein the weight ratio of mercaptobenzothiazole to added ferrous ion is from about 1:1 to about 1:4.

3. The method of claim 1, wherein said added ferrous ion is provided by $K_4Fe(CN)_6 \cdot 3H_2O$.

* * * * *